US006506074B2

(12) United States Patent
Hashimoto

(10) Patent No.: US 6,506,074 B2
(45) Date of Patent: Jan. 14, 2003

(54) CARD EDGE CONNECTOR ASSEMBLY FOR TIERED DAUGHTER BOARDS

(75) Inventor: Shinichi Hashimoto, Kanagawa (JP)

(73) Assignee: Tyco Electronics, Amp, K.K., Kanagawa (JP)

( * ) Notice: Subject to any disclaimer, the term of this patent is extended or adjusted under 35 U.S.C. 154(b) by 0 days.

(21) Appl. No.: 09/950,343

(22) Filed: Sep. 11, 2001

(65) Prior Publication Data

US 2002/0031952 A1 Mar. 14, 2002

(30) Foreign Application Priority Data

Sep. 12, 2000 (JP) ..... 2000-276316

(51) Int. Cl.[7] ..... H01R 13/60; H01R 13/66; H01R 24/00

(52) U.S. Cl. ..... 439/541.5; 439/637

(58) Field of Search ..... 439/637, 541.5, 439/326, 79, 80, 540.1

(56) References Cited

U.S. PATENT DOCUMENTS 6,126,472 A * 10/2000 Choy ..... 439/328
6,168,458 B1 * 1/2001 Kraft ..... 439/189
6,176,737 B1 * 1/2001 Choy ..... 439/541.5
6,261,106 B1 * 7/2001 Tung ..... 439/541.5

FOREIGN PATENT DOCUMENTS

JP 3022230 7/1996 ..... H01R/24/00

OTHER PUBLICATIONS

Patent Abstracts of Japan, Publication No. 08–190967, dated Jul. 23, 1996.

* cited by examiner

*Primary Examiner*—Lynn D. Feild
*Assistant Examiner*—Chandrika Prasad

(57) ABSTRACT

The present invention allows easy inspection of the conditions of soldering of a plurality of first and second contacts in a card edge connector assembly in which daughter boards are stacked in a plurality of tiers. Each of the first contacts (12) has a main body (12*a*), bent contact parts (12*c*) which extend into the accommodating recesses (2 and 4) via contact part passage grooves (39 and 41), and a tine (12*d*) on the lower end of the main body (12*a*). The plurality of second contacts (13) are constructed from contact members (14 and 15), and a conductive member (17) which electrically connect the contact members (14 and 15) on the rear part of the housing (6). Tines (15*g*) are formed on the lower ends of the contact members (15). The first contacts (12) are attached from the rear part of the housing (6), and the contact members (14 and 15) of the second contacts (13) are attached from the front part of the housing (6).

10 Claims, 7 Drawing Sheets

CARD EDGE CONNECTOR ASSEMBLY FOR TIERED DAUGHTER BOARDS

BACKGROUND OF THE INVENTION

The present invention relates to a card edge connector assembly in which daughter boards are mounted, and more specifically, to a card edge connector assembly having daughter board accommodating recesses installed in a plurality of tiers.

DESCRIPTION OF THE PRIOR ART

A module board electrical connector of the type in which two daughter boards are stacked in horizontal positions, as disclosed in Japanese Patent No. 3022230, is known as a card edge connector assembly in which daughter boards are accommodated in a plurality of tiers (e.g., in which two daughter boards are accommodated). Such an electrical connector has contacts that extend into each of two daughter board accommodating recesses (i.e., upper and lower daughter board accommodating recesses). The tines of all of the contacts (i.e., the leg parts of the contacts that are connected to the mother board) are positioned on the opposite side of the housing from the daughter board insertion side.

In the conventional electrical connector, the tines of the contacts used for the upper daughter board accommodating recess hide the tines of the contacts used for the lower daughter board accommodating recess. Accordingly, the tines of the contacts used for the lower daughter board accommodating recess cannot be visually checked from the outside, making visual inspection of the conditions of soldering to the mother board difficult. Furthermore, even if it is ascertained that the soldering is defective, the soldering tool cannot be inserted into the defective area, making repair of the soldering virtually impossible.

Additionally, the pitch of the tines in the direction in which the tines are lined-up in the respective rows is half the installation pitch of the contacts. Consequently, the spacing of the connecting parts used for connection to the mother board is narrow, so that short circuits between the soldering connections used to accomplish fastening to the mother board (i.e., so-called solder bridges) tend to be generated. As a result, defective products tend to be produced.

It is also conceivable that the tines of the contacts on the lower side among the contacts used for the upper daughter board accommodating recess might be installed on the daughter board insertion side of the housing. In such a case, however, the tines would interfere with the insertion of the daughter board into the lower daughter board accommodating recess.

The present invention provides a card edge connector assembly in which the conditions of soldering of the contacts of a card edge connector assembly that has daughter board accommodating recesses in a plurality of tiers can easily be checked by visual inspection. The present invention also provides a card edge connector assembly in which solder bridges between the tines tend not to be formed.

SUMMARY OF THE INVENTION

One embodiment of the present invention provides a card edge connector assembly equipped with an insulating housing that is attached to a mother board. The housing has daughter board accommodating recesses that extend parallel to the longitudinal axis and are formed in a plurality of tiers in the vertical direction in the front part of the housing. A plurality of contacts are disposed in rows parallel to the longitudinal axis on the upper and lower sides inside each of the daughter board accommodating recesses.

Each of the contacts has either an upper-side contact part, which is disposed on the upper side, or a lower-side contact part, which is disposed on the lower side. The contacts are connected to the mother board via a tine. The mother board is electrically connected to the daughter boards by mounting the daughter boards in the respective daughter board accommodating recesses and causing the daughter boards to contact the contact parts.

The plurality of contacts consist of a plurality of integral first contacts. The first contacts have contact parts on one of the sides mounted from the rear part of the housing so that the contact parts straddle the respective tiers, and have the tines in the rear part. A plurality of second contacts have a plurality of separate contact members having the contact parts on the other side respectively mounted in the tiers from the front part of the housing. The contact members are connected to each other by a conductive member in the rear part, avoiding the daughter board accommodating recesses. The contact members positioned in the lowest tier have the tines.

Accordingly, the tines can be split into two groups disposed on the front and rear of the housing, so that the conditions of soldering of the tines can easily be checked by visual inspection. Defective products can be excluded, or even if the soldering is defective, the soldering can easily be repaired, so that the quality and yield of products can be improved. Furthermore, by distributing the tines on the front and rear of the housing, it is possible to avoid an excessively narrow pitch, so that solder bridges tend not to be formed.

DETAILED DESCRIPTION OF THE PREFERRED EMBODIMENT

Figure 1A:
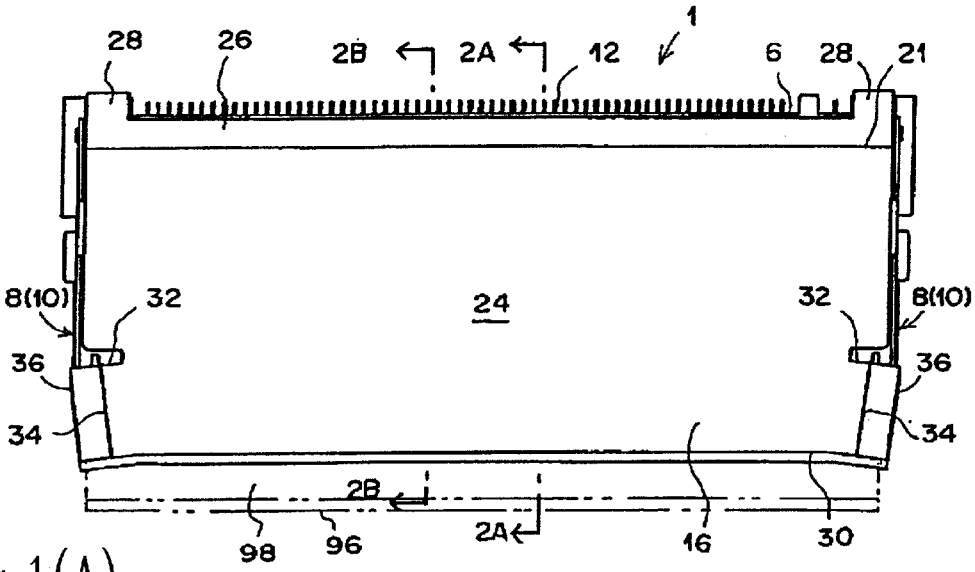
FIG. 1(A) is a plan view of the card edge connector assembly.
Figure 1B:
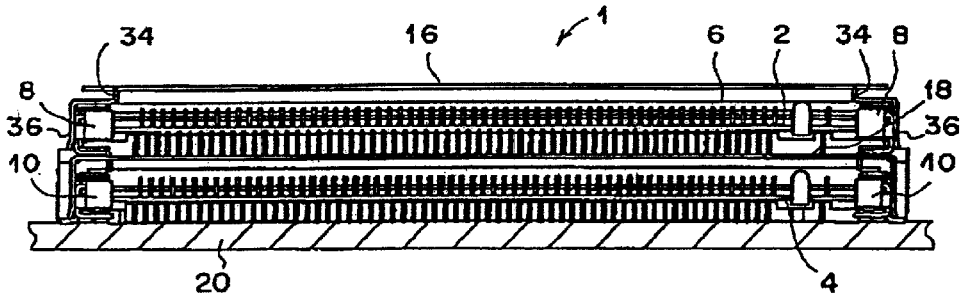
FIG. 1(B) is a front view of the card edge connector assembly.
Figure 1C:
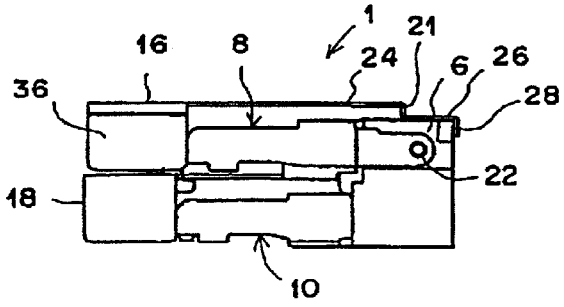
FIG. 1(C) is a side view of the card edge connector assembly.

A preferred embodiment of the card edge connector assembly of the present invention (hereafter referred to as "assembly") is described herein with reference to the attached figures. FIG. 1 shows the assembly of the present invention in a case where the assembly 1 is constructed as an assembly of the type in which two boards are stacked in horizontal positions. The assembly 1 has an insulating housing 6 which has an upper or second daughter board accommodating recess 2 and a lower or first daughter board accommodating recess 4, and which is attached to a mother board 20 (FIG. 1(B)).

Figure 2A:
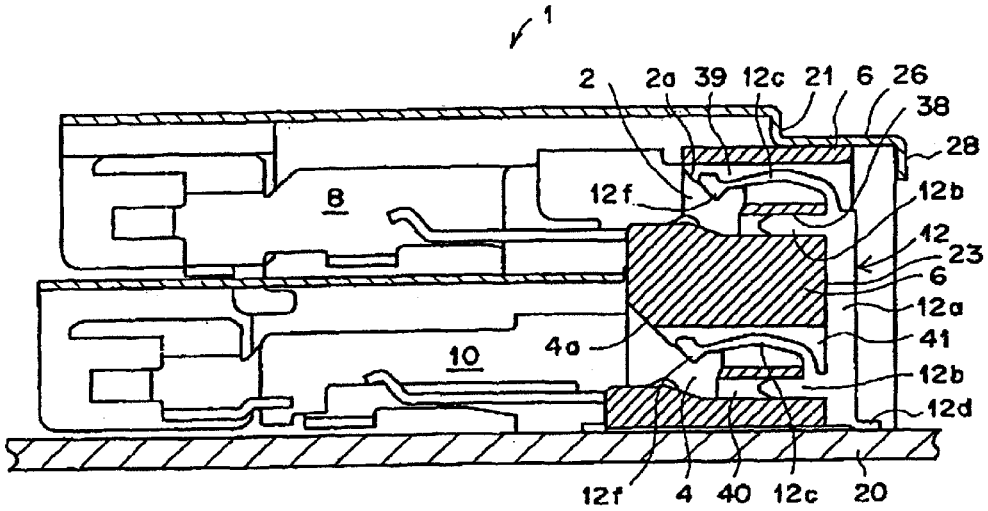
FIG. 2(A) is a sectional view along line 2A—2A in FIG. 1(A)
Figure 2B:
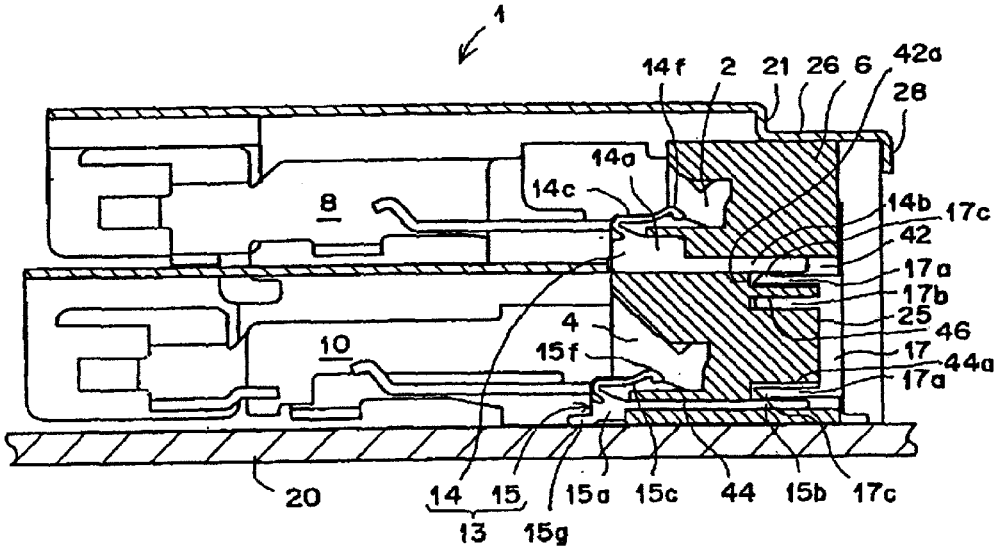
FIG. 2(B) is a sectional view along line 2B—2B in FIG. 1(A)

The two parallel accommodating recesses 2 and 4 (FIG. 1(B)) extend parallel to the longitudinal axis of the housing 6. A plurality of first contacts 12, shown in FIG. 2(A), are attached to the rear part (i.e., the upper parts in FIG. 1(A)) of the housing 6, facing the accommodating recesses 2 and 4. A plurality of second contacts 13 made up of contact members 14, 15, shown in FIG. 2(B), are attached to the front part of the housing 6, extending into the accommodating recesses 2 and 4. As shown in FIG. 1(A), the lower or first daughter board (card) 96 and the upper or second daughter board (card) 98 are inserted into the accommodating recesses 2 and 4 from the front part of the assembly 1.

Two pairs of latch members 8 and 10 are respectively attached to both end parts of the housing 6 in positions corresponding to the accommodating recesses 2 and 4. The latch members 8 and 10 respectively anchor the inserted daughter boards 98 and 96. The respective pairs of latch members 8 and 10 are arranged so that each pair shows left-right symmetry. The upper latch members 8 are attached so that the upper latch members 8 can rotate on supporting shafts 22 which protrude from the housing 6 as integral parts of the housing (FIG. 1(C)). The supporting shafts 22 may also be members that are separate from the housing 6.

As shown in FIG. 1(A) and FIG. 2(A), the plates or connecting members 16 and 18 are substantially rectangular in shape and extend to both ends of the housing 6. The plates 16 and 18 are attached to the housing 6 in positions corresponding to the latch members 8 and 10. Each of the plates 16 and 18 is formed by stamping from a single metal plate. As shown in FIG. 1(A), the upper plate 16 has a flat main surface 24, and a rear surface 26, which extends in the same direction as the main surface 24 is formed on the rear part of the upper plate 16 with step part 21 which extends parallel to the longitudinal axis of the housing 6 interposed between the main surface 24 and rear surface 26. Attachment parts 28 of the cross-sectional L-shape which turn into the rear surface of the housing 6 extend from both end parts of the rear surface.

Cut-outs 32 which extend parallel to the longitudinal axis of the plate 16 are formed in the vicinity of both sides of the front end 30 of the plate 16. Substantially rectangular holding plates 36 which engage with the outsides of the upper latch members 8 are formed via step parts 34 which extend toward the front end 30 from the respective cut-outs 32. The holding plates 36 are constrained inward on the side of the front end 30 in conformity to the external shape of the upper latch members 8. The holding plates 36 prevent the upper latch members 8 from opening outward and disengaging from the daughter board after the second daughter board 98 has been inserted and engaged with the upper latch members 8. The main surface 24 is positioned relatively high (at the top by the step parts 21 and 34) to ensure space for the ICs (not shown in the figures) that are mounted on the daughter board 98.

The cross-sectional shape of the assembly 1 is described with reference to FIG. 2. The housing 6 has upper and lower contact through-holes 38 and 40 used for the attachment of the contacts 12 from the rear of the housing 6 (FIG. 2(A)), and upper and lower through-holes 42 and 44 used for the attachment of the contact members 14 and 15 from the front of the housing 6 (FIG. 2(B)), in positions that are shifted parallel to the longitudinal axis of the housing 6. The respective through-holes 38 and 40 are aligned vertically and communicate with the accommodating recesses 2 and 4. The through-holes 42 and 44 are similarly aligned in the vertical direction, and are adjacent to the accommodating recesses 2 and 4. Furthermore, contact part passage grooves 39 and 41 which communicate with the accommodating recesses 2 and 4 are formed adjacent to the through-holes 38 and 40.

Each of the contacts 12 has a long, slender main body, 12*a* which extends upward and downward, and is disposed in a contact accommodating groove 23 formed in the housing 6. Attachment tabs 12*b* are press-fitted in the through-holes 38 and 40 from the main body 12*a*. Bent contact parts 12*c* (upper-side contact parts) respectively extend into the accommodating recesses 2 and 4 via the contact part passage grooves 39 and 41 from the areas of the attachment tabs 12*b*. A tine 12*d* (on the lower end of the main body 12*a*) is soldered to a conductive pad (not shown in the figures) on the mother board 20. Because the tine 12*d* protrudes from the rear part of the housing 6, the conditions of soldering can be checked from the outside by visual inspection.

The tip end portions of the contact parts 12*c* have contact points 12*f* that make electrical connections with conductive pads (not shown in the figures) on the daughter boards that are inserted into the accommodating recesses 2 and 4. The upper wall surfaces 2*a* and 4*a* that demarcate the accommodating recesses 2 and 4 are inclined upward at a steep angle, so that the daughter boards can be inserted into the accommodating recesses 2 and 4 at a similar angle. The lower latch members 10 have press-fitting parts (not shown in the figures) which have barbs on the side edges, and the lower latch members 10 are attached to the housing 6 by inserting the press-fitting parts into grooves (not shown in the figures) formed in the housing 6. The lower latch members 10 are fastened to the housing 6 so that the lower latch members 10 cannot rotate upward or downward relative to the housing.

The contact members 14 or 15 have a main body 14*a* or 15*a*. An attachment tab 14*b* or 15*b* extends horizontally from the main body 14*a* or 15*a* and is press-fitted in the corresponding through-hole 42 or 44. A contact part (lowerside contact part) 14*c* or 15*c* extends into the accommodating recess 2 or 4 while being bent from the main body 14*a* or 15*a*. The tip end of the contact part 14*c* or 15*c* forms a contact point 14*f* or 15*f* that contacts an electrode (not shown in the figures) on the daughter board 96 or 98. A longitudinal groove 25 is formed in the rear part of the housing 6 in a position aligned with the contact member 14 or 15. A C-shaped connecting part (conductive member) 17 formed by stamping a metal plate is disposed in the groove 25.

Contact legs 17*a* are formed on both ends of the connecting part 17, and an attachment tab 17*b* is formed between the contact legs 17*a*. Outward-facing projections 17*c* are respectively formed on the tip end portions of the contact legs 17*a*. The attachment tab 17*b* is fastened by press-fitting in a corresponding groove 46 in the housing 6, and the contact legs 17*a* are inserted into corresponding grooves 42*a*, 44*a* in the housing 6. Since the grooves 42*a* and 44*a* respectively communicate with and run adjacent to the through-holes 42 and 44, the contact legs 17*a* contact the attachment tabs 14*b* or 15*b* of the contact members 14 or 15, so that the contact members 14 and 15 are electrically connected. As a result, the contact members 14 and 15 form integral contacts (second contacts) 13.

A tine 15*g*, which extends forward and to the outside of the housing 6, is formed on the lower end of the contact member 15. Accordingly, the tines 15*g* may be visually checked from the outside, allowing the conditions of soldering to the mother board to be checked. Since the tines 15*g* and 12*d* are distributed on the front and rear of the housing 6, the pitch of the tines is the same as the pitch of the contacts 12 and 13, so that the pitch is not excessively narrow. Accordingly, solder bridges do not form between adjacent tines 15*g* or 12*d* in the direction of length of the housing 6. In the present working configuration, a construction is used in which the first contacts 12 have upper-side contact parts 12*c*, and the second contacts 13 have lower-side contact parts 14*c* and 15*c*. The respective contacts 12 and 13, however, may also have contact parts 14*c*, 15*c*, 12*c* on the opposite sides.

Figure 3A:
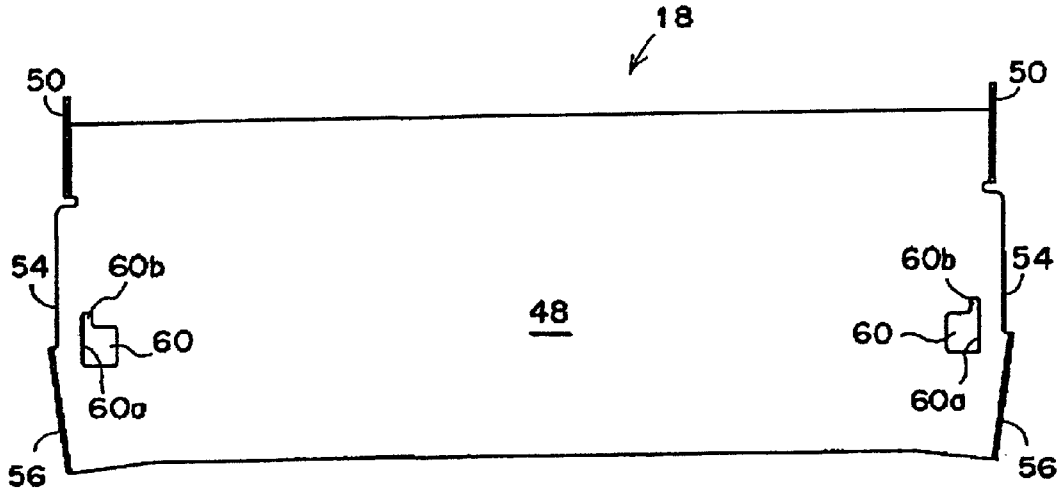
FIG. 3(A) is a plan view of the lower plate.
Figure 3B:
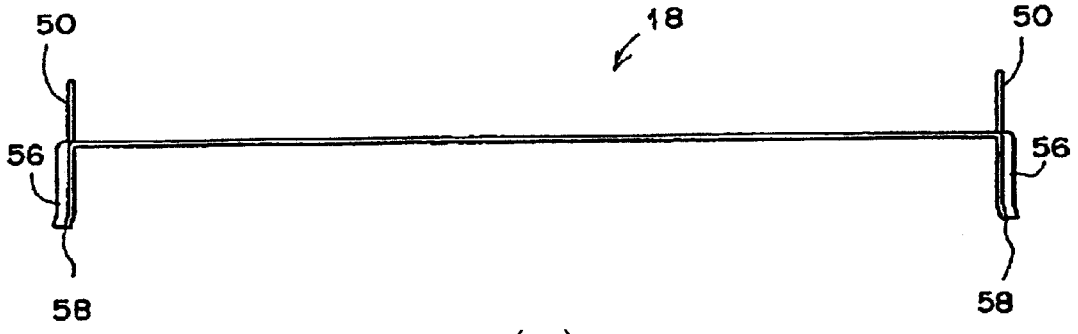
FIG. 3(B) is a front view of the lower plate.
Figure 3C:
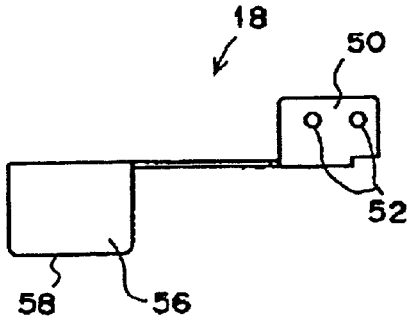
FIG. 3(C) is a side view of the lower plate.

The lower plate 18 is described with reference to FIG. 3. As shown in FIG. 3(A), the plate 18 has a substantially rectangular shape similar to that of the plate 16. Rectangular attachment parts 50 which are bent upward relative to the main surface 48 of the plate 18 are formed on both ends of the rear part of the plate 18. Two attachment holes 52 which are disposed parallel to the main surface 48 are formed in each of the attachment parts 50. The upper latch members 8 are attached to the attachment holes 52.

Rectangular holding plates 56, which are bent downward, are formed on the front parts of both end edges 54 of the plate 18. The holding plates 56 are formed so that the plates are constrained inward in the same manner as the holding plates 36 of the plate 16 that covers the upper latch members 8. The lower ends 58 of the holding plates 56 open slightly outward. Substantially rectangular openings or overstress-preventing means 60 are formed in the main surface 48 near the rear ends of the respective holding plates 56. The outside edges 60*a* of the respective openings 60 are caused to extend to the rear, and slots 60*b* are formed in the rear parts of the openings 60. The openings 60 act in conjunction with the upper latch members 8.

The upper latch members 8 are described with reference to FIG. 4. Each latch member 8 is formed by stamping and bending a single metal plate. Each latch member 8 has a long, slender flat-plate part (i.e., an arm 62). A daughter board holding part 64 is formed on the front end (i.e., the left end in FIG. 4(A)) of the flat-plate part 62. A hole 65, pivot-supported on the supporting shaft 22 of the housing 6 (FIG. 1(C)), is formed in the rear end portion of the flat-plate part 62. The daughter board holding part 64 has a daughter board holding piece 66 which is formed by being bent from the upper edge of the tip end portion of the flat-plate part 62, and a hook-shaped hook part 68 which is caused to protrude by bending the tip end of the flat-plate part 62 inward.

The daughter board holding piece 66 has a taper 66*a* which is inclined toward the inside (i.e., toward the second daughter board 98) and a stopping surface 66*b* that presses against the upper daughter board 98. The taper 66*a* guides the upper daughter board 98 when the upper daughter board 98 is inserted, and causes the flat-plate part 62 to flex outward, so that the upper daughter board 98 can be accommodated. When the accommodated daughter board 98 reaches the stopping surface 66*b*, the flat-plate part 62 elastically recovers, so that the upper daughter board 98 is restrained by the stopping surface 66*b* and prevented from returning upward. The hook parts 68 of the upper latch members 8 engage with circular-arc-form cut-outs 98*a* formed in the upper daughter board 98 (see FIG. 7(A)), so that the upper daughter board 98 is prevented from slipping out in the forward direction (i.e., toward the left in FIG. 4(B)).

Figure 4A:
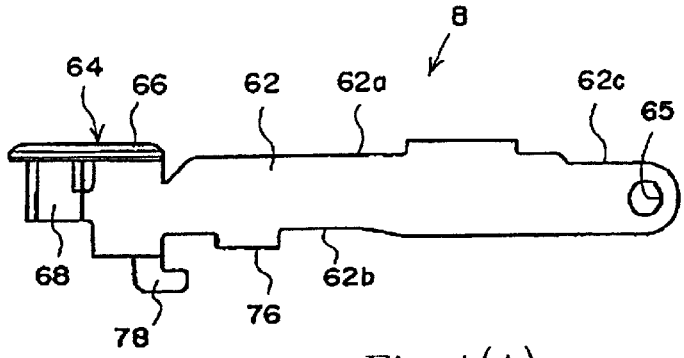
FIG. 4(A) is a first side view of one of the upper latch members.
Figure 4B:
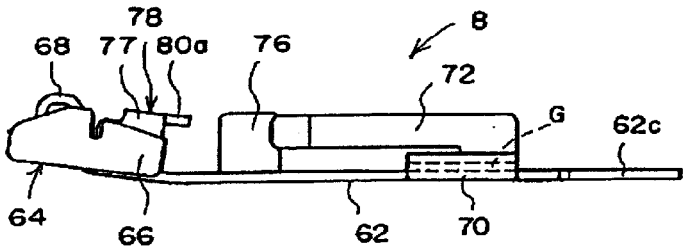
FIG. 4(B) is a plan view of one of the upper latch members.
Figure 4C:
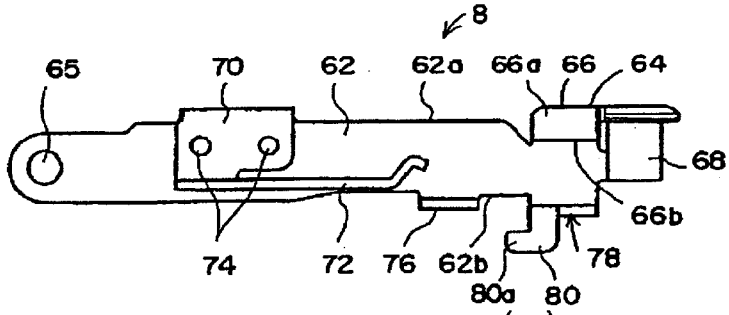
FIG. 4(C) is a second side view of one of the upper latch members.
Figure 4D:
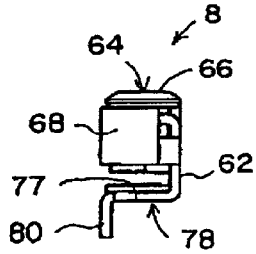
FIG. 4(D) is a front view of one of the upper latch members.

As shown in FIGS. 4(B) and 4(C), a fastening part 70 which extends upward and is bent parallel to the flat-plate part 62 is formed near the hole 65 on the upper edge 62*a* of the flat-plate part 62. The bent tip end of the fastening part 70 is further bent at right angles to the flat-plate part 62, and forms an elastic contact part 72 which extends toward the daughter board holding part 64. The tip end portion of the elastic contact part 72 is bent upward, and a ground electrode (not shown in the figures) on the mounted daughter board 98 makes contact with this tip end portion, grounding the daughter board 98. A space G which accommodates the attachment part 50 of the plate 18 is formed between the fastening part 70 and the flat-plate part 62 (FIG. 4(B)). The projections 74, which protrude toward the flat-plate part 62, are formed on the fastening part 70 in positions corresponding to the attachment holes 52 of the plate 18.

An overstress-preventing part 76 is formed on the lower edge 62*b* of the flat-plate part 62 in a position corresponding to the tip end portion of the elastic contact part 72 to prevent excessive deformation of the elastic contact part 72. An extension part 77 which extends at right angles to the flat-plate part 62, and a regulating part 78 which has an L-shaped part 80 that extends further downward from the extension part 77, are formed on the lower edge 62*b* of the flat-plate part 62 on the opposite side from the daughter board holding part 64. The L-shaped part 80 has a protruding part 80*a* that extends rearward parallel to the flat-plate part 62.

Figure 5A:
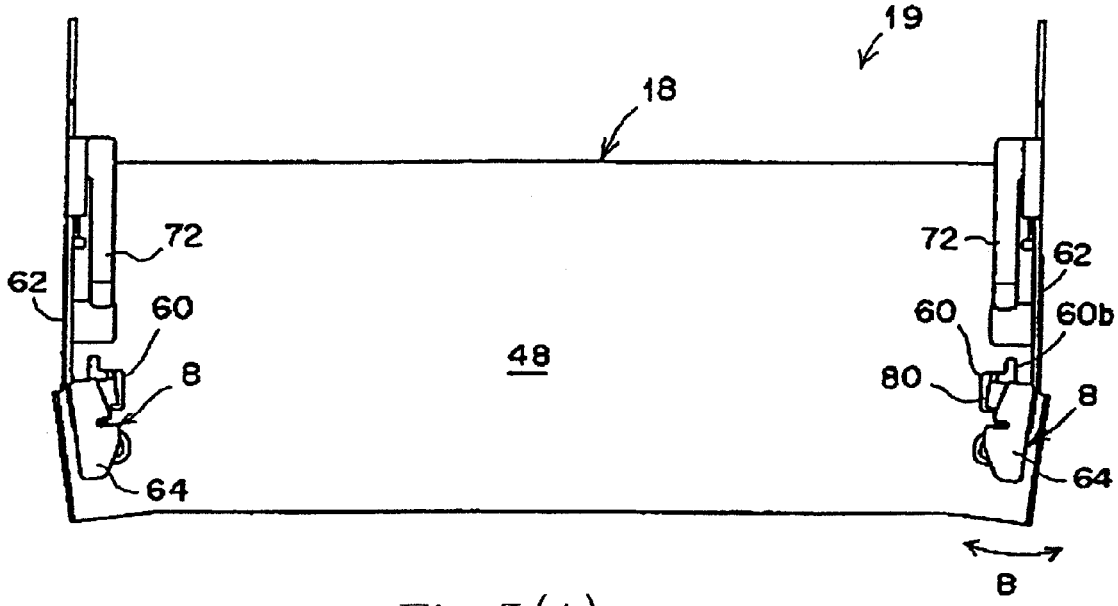
FIG. 5(A) is a plan view of the sub-assembly in which the upper latch members are attached to the plate.
Figure 5B:
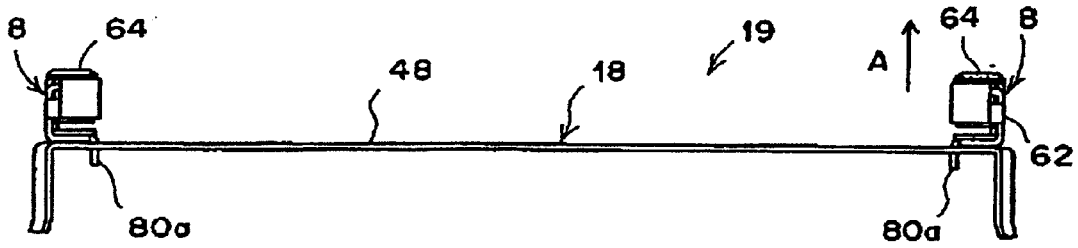
FIG. 5(B) is a front view of the sub-assembly in which the upper latch members are attached to the plate.
Figure 5C:
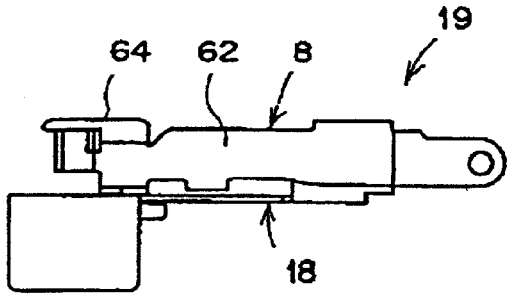
FIG. 5(C) is a side view of the sub-assembly in which the upper latch members are attached to the plate.

The sub-assembly in which the upper latch members 8 are attached to the lower plate 18 is described with reference to FIG. 5. The fastening parts 70 of the respective latch members 8 are attached to the attachment parts 50 of the plate 18 so that the elastic contact parts 72 are positioned on the inside. In this case, the two projections 74 on the fastening part 70 of the upper latch member 8 (FIG. 4(C)) are engaged and fastened in the two attachment holes 52 of the plate 18 (FIG. 3(C)), and the L-shaped parts 80 of the upper latch members 8 enter the openings 60 in the plate 18. When the L-shape parts 80 enter the openings 60, the protruding parts 80*a* of the L-shaped parts 80 pass through the slots 60*b* of the openings 60, so that the protruding parts 80*a* are disposed on the underside of the main surface 48 of the plate 18.

In cases where no external force is applied to the daughter board holding parts 64, the protruding parts 80*a* are positioned in the portions of the openings 60 that are removed from the slots 60*b*. Specifically, the protruding parts 80*a* are positioned as shown in FIG. 5(A). Accordingly, even in cases where a force A that is directed upward (FIG. 5(B)) is applied to the upper latch members 8, the protruding parts 80*a* contact the main surface 48 of the plate 18 from below, so that movement is restricted. Accordingly, the upper latch members 8 are prevented from leaving the plate 18. When the flat-plate parts 62 accommodate the upper daughter board 98, the upper latch members 8 can move within the range in which the L-shaped parts 80 can move, as indicated by the arrow B inside the openings 60 (FIG. 5(A)). In this way, the upper latch members 8 and plate 18 are assembled into an integral unit, and are thus constructed as a plate sub-assembly 19. Thus, the openings 60 and protruding parts 80*a* act in conjunction, so that overstress of the upper latch members 8 is prevented.

The method of attachment of the daughter boards 96 and 98 is described with reference to FIGS. 6 and 7. In FIG. 6, the upper plate 16 has been removed from the assembly 1. In FIG. 7, the sub-assembly 19 has been closed following the attachment of the lower daughter board 96.

Figure 6A:
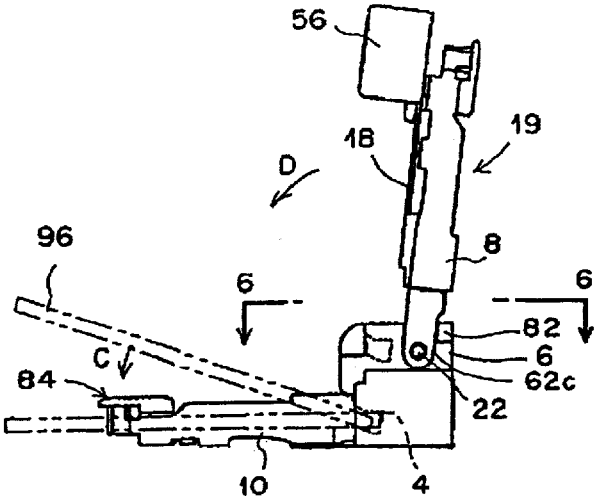
FIG. 6(A) is a side view of the assembly which shows a state in which the sub-assembly has been opened by being rotated about the supporting shafts of the housing for attachment of the lower daughter board.

As shown in FIG. 6, the sub-assembly 19 is attached via the upper latch members 8 to the supporting shafts 22 that protrude from both ends of the housing 6 (whose length is in the lateral direction). Projecting parts (supporting parts) 82 are caused to protrude outward on both ends of the rear part of the housing 6. The projecting parts 82 are contacted by the upper edges 62*c* near the rear parts of the flat-plate parts 62 of the upper latch members 8 when the sub-assembly 19 is opened in order to mount the lower daughter board 96, maintaining the sub-assembly 19 in an open or withdrawn state. In this state, the lower daughter board 96 is inserted at an inclination into the lower accommodating recess 4 (FIG. 6(A)), and is pressed downward or rotated as indicated by the arrow C, so that the lower daughter board 96 is attached to the lower latch members 10. Thus, in the case of the lower daughter board 96, since the upper latch members 8 are rotated beforehand and withdrawn to the outside of the insertion path of the lower daughter board 96 prior to the insertion of the lower daughter board 96, the upper latch members 8 do not interfere with the insertion of the lower daughter board 96.

Figure 6B:
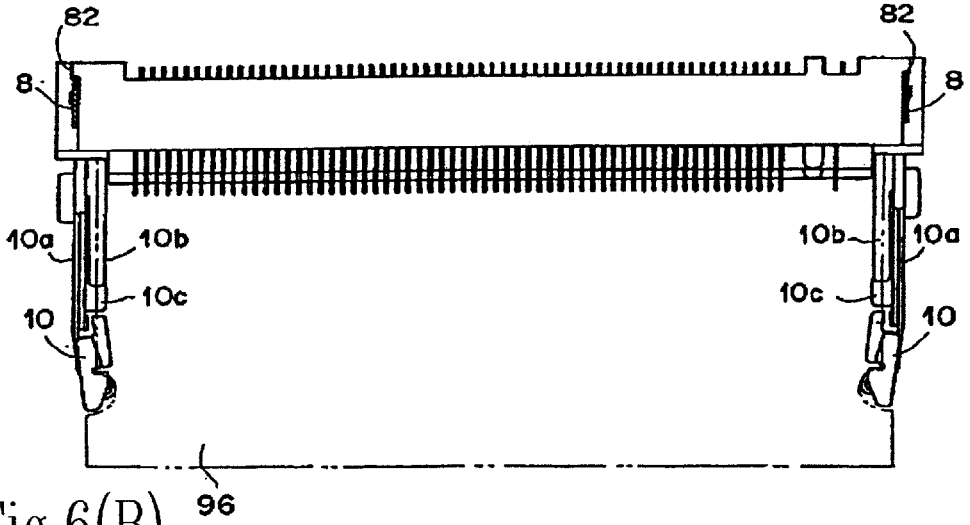
FIG. 6(B) is a sectional plan view along line 6—6 in FIG. 6(A)
Figure 6C:
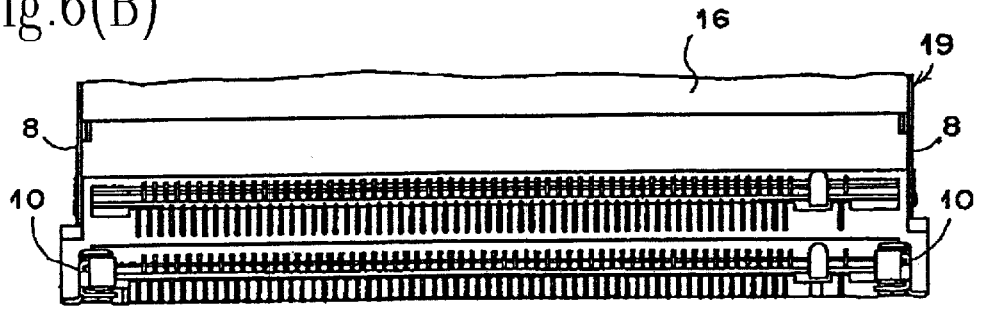
FIG. 6(C) is a front view of the assembly showing a state for attachment of the lower daughter board.

The state in which the lower daughter board 96 is attached to the lower latch members 10 is indicated by an imaginary line in FIG. 6(B) (the lower daughter board 96 is not shown in FIG. 6(C)). After the lower daughter board 96 has been attached, the sub-assembly 19 is rotated onto the lower daughter board 96 as indicated by the arrow D in FIG. 6(A), resulting in the state shown in FIG. 7. In this case, the holding plates 56 of the plate 18 are positioned to the outside of the daughter board holding parts 84 of the lower latch members 10, so that the lower daughter board 96 is prevented from slipping-out due to the flexing of the daughter board holding parts 84 of the latch members 10 to the outside. Because the lower edges 58 of the holding plates 56 open slightly, the edges serve as guides that effect mutual positioning at the time of engagement with the daughter board holding parts 84.

The lower latch members 10 have a shape similar to that of the upper latch members 8. The flat-plate parts 10*a* of the lower latch members 10 are folded back at the upper edge of the rear part, so that elastic contact parts 10*b* that make grounding contact with the lower daughter board 96 are formed in the same manner as the upper latch members 8. Overstress-preventing parts 10*c* (similar to those of the upper latch members 8) which prevent overstress of the elastic contact parts 10*b* are caused to protrude inward from the lower edges of the flat-plate parts 10*a*.

Figure 7A:
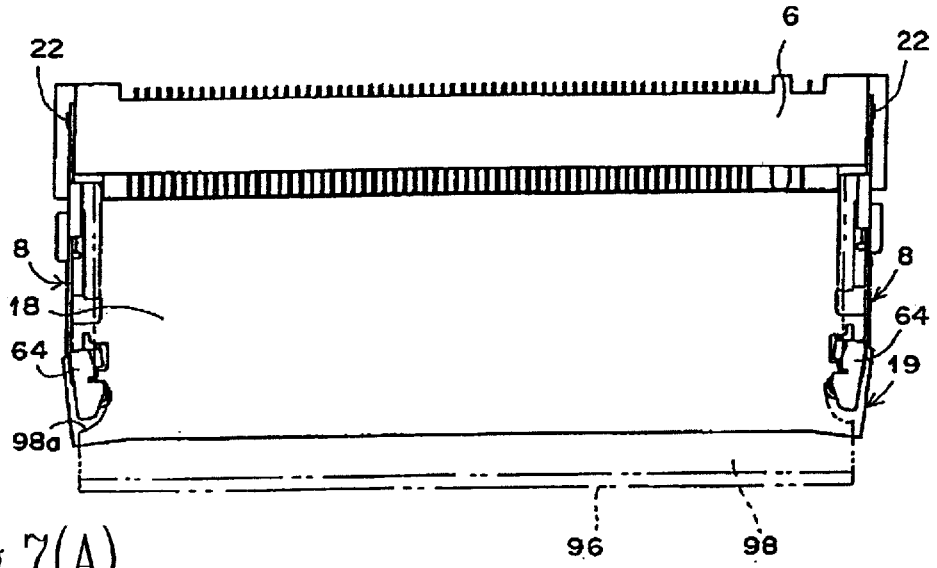
FIG. 7(A) is a plan view of the sub-assembly in a closed position following the attachment of the lower daughter board.
Figure 7B:
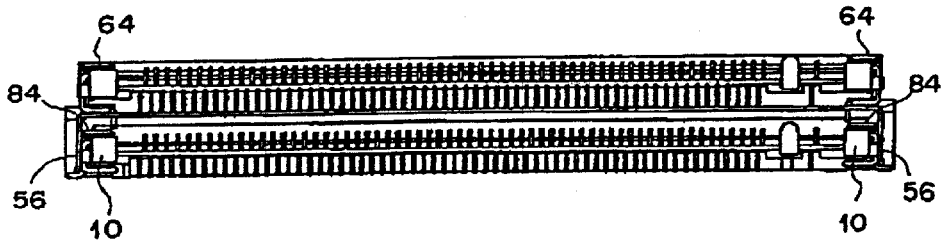
FIG. 7(B) is a front view of the sub-assembly in a closed position following the attachment of the lower daughter board.
Figure 7C:
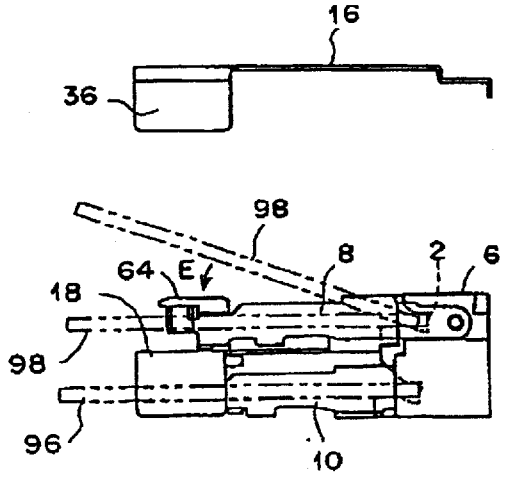
FIG. 7(C) shows a side view together with the upper plate of the sub-assembly in a closed position following the attachment of the lower daughter board.

As shown in FIG. 7(A), the sub-assembly 19 covers the lower latch members 10, so that the lower latch members 10 cannot be seen from above. In FIG. 7(B), the holding plates 56 restrict the movement of the lower latch members 10 to the outside. The upper daughter board 98 is inserted into the upper accommodating recess 2 at an inclination (FIG. 7(C)) and is attached to the upper latch members 8 by being rotated in the direction indicated by the arrow E. After the upper daughter board 98 has been attached (FIG. 7(A)), the upper plate 16 is attached to the housing 6. As shown in FIG. 1(B), the holding plates 36 of the plate 16 are disposed on the outside of the daughter board holding parts 64, so that the flexing of the daughter board holding parts 64 to the outside is restricted.

The present invention was described in detail above with reference to a preferred embodiment. This working configuration, however, is merely an example. The present invention is not limited to such an embodiment. For example, the assembly 1 is an assembly of the type that is mounted horizontally on the mother board 20. The assembly 1 may also be an assembly of the type that is attached in a vertical position. In such a case, the dimensions in the direction of height are increased, however, such a configuration is advantageous in that the mounting area on the mother board is reduced.

What is claimed is:

1. A card edge connector assembly comprising:

an insulating housing attached to a mother board;

the insulating housing having a front part and a rear part and a first daughter board accommodating recess and a second daughter board accommodating recess formed in a plurality of tiers in the front part of the insulating housing;

the first and the second daughter board accommodating recesses having an upper side and a lower side;

a plurality of first contacts having integral first and second contact parts mounted from the rear part of the housing such that the first contact part is received in the upper side of the first daughter board accommodating recess and the second contact part is received in the upper side of the second daughter board accommodating recess;

the first contacts having a first tine that extends from the rear part of the housing and is mounted to the mother board;

a plurality of second contacts having first and second contact members mounted from the front part of the housing such that the first contact member is received in the lower side of the first daughter board accommodating recess and the second contact member is received in the lower side of the second daughter board accommodating recess;

the second contact member having a second tine that extends from the front part of the housing and is mounted to the mother board; and a conductive member mounted in the rear part of the housing opposite the first and the second daughter board accommodating recesses that electrically connects the first contact member to the second contact member.

2. The card edge connector assembly of claim 1, wherein the first contacts have first main bodies integral with the first and second contact parts from which the first and second contact parts extend.

3. The card edge connector assembly of claim 2, wherein the first main bodies have a first attachment tab press fit into a first through-hole of the housing.

4. The card edge connector assembly of claim 1, wherein the first tine extends from the rear part of the housing to allow visual inspection when the first tine is soldered to the mother board.

5. The card edge connector assembly of claim 1, wherein the second tine extends from the front part of the housing to allow visual inspection when the second tine is soldered to the mother board.

6. The card edge connector assembly of claim 1, wherein the first tines and the second tines have a pitch substantially the same as the first contacts and the second contacts to prevent solder bridges from forming between the first tines and the second tines.

7. The card edge connector assembly of claim 1, wherein the conductive member has a conductive member attachment tab press fit into a second through hole of the housing and a first contact leg that extends toward the first contact member and a second contact leg that extends toward the second contact member.

8. The card edge connector assembly of claim 7, wherein the conductive member and the first contact leg and the second contact leg form a substantially c-shape.

9. The card edge connector assembly of claim 7, wherein the first contact member has a first contact member attachment tab that contacts the first contact leg and the second contact member has a second contact member attachment tab that contacts the second contact leg to electrically connect the first contact member to the second contact member.

10. The card edge connector assembly of claim 1, wherein the insulating housing has first upper and lower contact through-holes in the rear part of the housing for receiving the first contacts and second upper and lower contact through-holes in the front part of the housing for receiving the second contacts.

* * * * *